United States Patent [19]

Kearsley

[11] 3,973,168

[45] Aug. 3, 1976

[54] WIRING CIRCUITS AND METHOD FOR MULTIPLE FLASH-BEACONS

[75] Inventor: Wayne A. Kearsley, Chelmsford, Mass.

[73] Assignee: Flash Technology Corporation of America, Nashua, N.H.

[22] Filed: June 16, 1975

[21] Appl. No.: 587,336

[52] U.S. Cl. ..... 315/232; 307/42; 315/200 A; 315/241 R; 315/313; 315/323; 315/325; 315/353; 340/25; 340/331

[51] Int. Cl.[2] ..... G08G 5/00; H05B 41/34

[58] Field of Search ..... 315/230, 232, 241 R, 315/241 S, 200 A, 312, 313, 323, 324, 325, 353, 360; 340/25, 77, 105, 331; 307/12, 15, 16, 29, 41, 42, 81

[56] References Cited

UNITED STATES PATENTS

| | | | |
|---|---|---|---|
| 2,478,908 | 8/1949 | Edgerton | 340/331 |
| 3,648,105 | 3/1972 | Sanford | 315/241 R X |
| 3,714,508 | 1/1973 | Harnden, Jr. et al. | 315/232 X |

*Primary Examiner*—Eugene La Roche
*Attorney, Agent, or Firm*—Thomas N. Tarrant

[57] ABSTRACT

A plurality of flash units mounted as warning, navigational or signal beacons are driven from a remote energy storage power converter with reduced number and or size of discharge current cables by common use of cables combined with sequential flashing such that the discharge current for only one flash lamp is carried by a cable at a given instant. By very close spacing, the sequential flashes may be made to appear simultaneous to the human eye.

7 Claims, 6 Drawing Figures

WIRING CIRCUITS AND METHOD FOR MULTIPLE FLASH-BEACONS

BACKGROUND OF THE INVENTION

1. Field of the Invention

The invention relates to circuits for firing electronic flash discharge lamps and particularly to such circuits used for flashing a plurality of lamps physically remote from the energy storage power converter.

2. Description of the Prior Art

There is an accelerating interest today in the use of high intensity flash beacons for navigational beacons and for warning beacons of various kinds. Intensities adequate for piercing light, fog, haze and rain and for long range perception by fast flying aircraft are possible at economical average power levels using flashlamps. However, energy storage converters are required to store up the energy for each flash over a finite interval of time and then to discharge it through the lamp. The instantaneous current levels typically run to hundreds of amperes requiring very low resistance cables between power converter and lamp. Unfortunately, it is not always easy to place the lamps and power converter in close proximity. For example, on a tall structure, such as a broadcast radio antenna or an industrial smokestack, it is difficult enough to install and maintain the necessary number of lamps without installing and maintaining heavy power converter apparatus at steeplejack heights. The alternative has been to run massive copper cables to the individual lamps. It has been a frequent practice to connect one side of a plurality of lamps to a common cable, but the conventional instantaneous flashing of all lamps has increased the burden for any common cable, requiring a larger wire size for common cables. Increasing cost of wire, particularly the preferred copper wire, is having a substantial cost effect on these systems.

SUMMARY OF THE INVENTION

In accordance with the present invention, circuits and methods of sequentially triggering a group of flashlamps are provided to substantially reduce cable requirements between a group of flashlamps and a remote energy storage and power source. The method lies in connecting at least one power cable to all the flashlamps in common, storing an electrical charge sufficient to flash all the lamps simultaneously and then triggering the required portion of the charge to each lamp in rapid sequence such that the peak instantaneous current through the common cable does not significantly exceed the peak instantaneous current required for one lamp at any given instant of time. The preferred embodiments include: a circuit for sequentially triggering discharge of separate energy storage capacitors to respective lamps which are also sequentially triggered; a circuit for sequentially triggering lamps connected each to a separate capacitor store and all connected in common to the other side of all the capacitor stores; and, a circuit for triggering a discharge from a large capacitor store to a small capacitor store and then triggering one of a group of lamps connected in common to the small capacitor to discharge that store through the triggered lamp, the small store is then sequentially recharged by triggering from the large store and the other lamps are sequentially triggered in like manner to flash all the lamps in rapid sequence.

Thus, it is an object of the invention to provide a novel systems for operating a plurality of flashlamps to flash substantially simultaneously from a remote power storage source with common use of one or more power cables for the flash discharge current.

It is a further object of the invention to provide novel flashing systems for sequentially firing a group of flashtubes remotely from an energy storage and power source at close enough intervals to appear simultaneous while spaced sufficiently to minimize peak current in common power cables.

It is a further object of the invention to provide novel methods of operating a group of flashtubes from a remote energy storage and power source with reduced power cable requirements.

Further objects and features of the invention will become apparent upon reading the following description together with the Drawing.

DESCRIPTION OF THE PREFERRED EMBODIMENT

Figure 1:
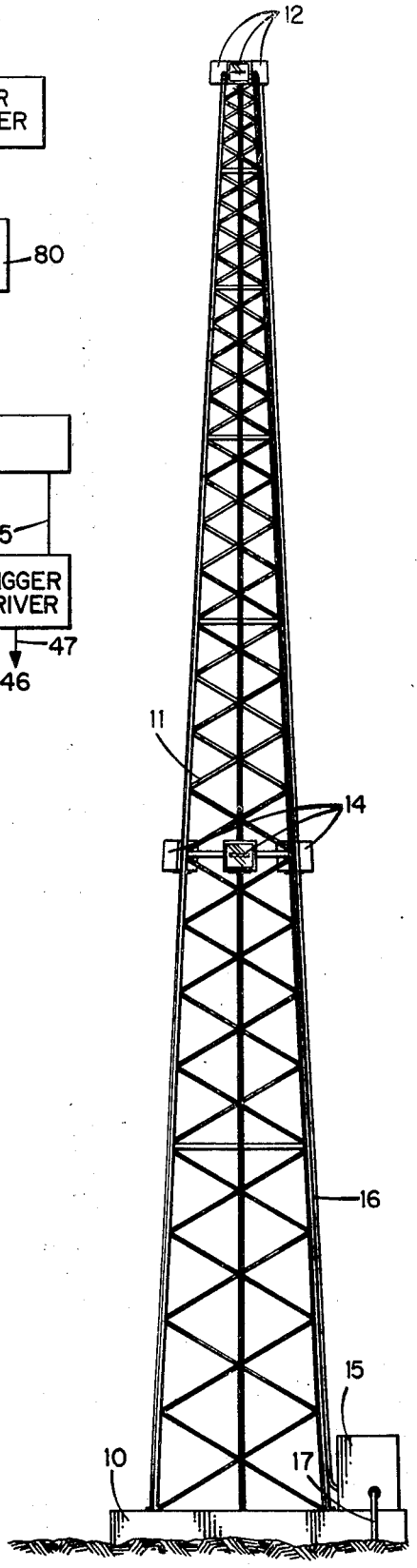
FIG. 1 is a perspective view of a radio tower with a group of flashlamps mounted as warning beacons.

Exemplary of utilization of the present invention is a radio transmitting antenna structure depicted as the antenna tower of FIG. 1. Similar structures are used for television transmitting antennas and for microwave antennas and links. Such an antenna structure is usually supported on a concrete base 10 and has a steel framework tower 11 extending 75 feet or more into the air. Such towers are frequently located in highly populated areas or on the top of high buildings and mountain peaks; in all instances, causing a threat to aircraft. Accordingly, warning beacons are installed to give adequate notice to the aircraft of the presence of the structure day and night.

Tower 11 has a triangular plan section. Three flash beacons 12 are located adjacent to the top and three further flash beacons 14 are located part way down the tower. At each of these levels, the three beacons are positioned at 120° intervals around the tower, and each beacon has a beam width of 120° or more in order to give full circumferential coverage.

Situated at the bottom of the tower on platform 10 is energy storage, power supply and control system 15 which provides energy to lamps 14 and 12 over cables 16 which run up the tower to the various lamps. An external power source (not shown) provides power to power supply 15 over connecting cable 17.

In a group of lamps, such as lamps 12 and 14 at a substantially single location, such as on tower 11, research has indicated that simultaneous group flashing is more conspicuous and identifying and less psychologically annoying to people in the vicinity than staggered flashing. Accordingly, it is the usual practice to flash all lights, such as this, simultaneously.

Figure 2:
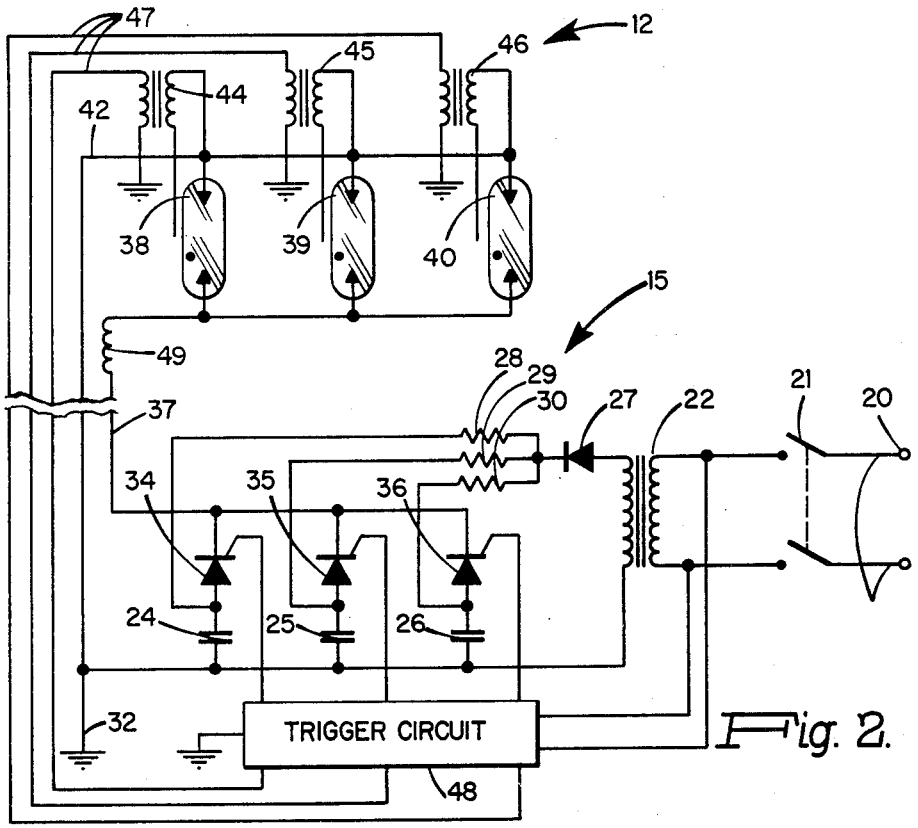
FIG. 2 is a simplified schematic diagram of a flash beacon system according to one embodiment of the invention.
Figure 3:
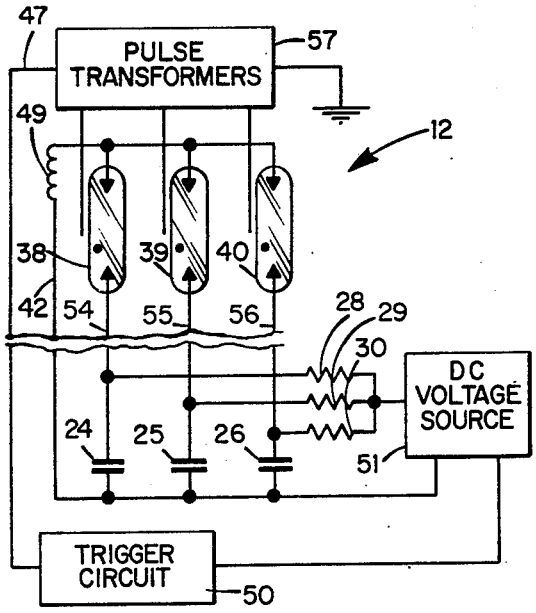
FIG. 3 is a simplified schematic diagram of a flash beacon system according to a second embodiment of the invention.

While all of the flash beacons in FIG. 1 could be operated by the same circuitry, FIGS. 2 and 3 show only operation of three flash beacons in order to simplify illustration and description.

Since power converters for operating flashlamps are basically simple but nevertheless vary considerably in the complexity of circuitry used, only the basic components are shown in the simplified diagram of FIG. 2. Thus, power from some conventional power source is supplied to line terminals 20 through on-off switch 21 and to power transformer 22 which serves the purpose of raising the voltage to that required to charge the flash discharge capacitors 24, 25 and 26. Rectifier 27 rectifies the high voltage current from transformer 22 and resistors 28, 29, and 30 are connected at one end in common to rectifier 27 and with their other ends connected to one side of capacitors 24, 25, and 26 respectively. The other side of capacitors 24, 25, and 26 are connected in common to ground reference 32 and to transformer 22 to complete the circuit with rectifier 27.

In common with the connections from resistors 28, 29, and 30, capacitors 24, 25, and 26 are connected to the anode electrodes of silicon controlled rectifiers 34, 35, and 36 respectively. The cathodes of silicon controlled rectifiers 34, 35, and 36 are connected by cable 37 through a pulse-shaping choke 49 to the anodes of remotely located flashtubes 38, 39, and 40. The cathodes of flashlamps 38, 39, and 40 are all connected in common to a second cable 42 which in turn leads back to reference 32.

Triggering means depicted as pulse transformers 44, 45, and 46 are desirably provided at the location of flashlamps 38, 39, and 40 respectively for providing ionizing triggering pulses for the flashlamps. Pulse transformers 44, 45, and 46 are driven by electrical driving signals provided over cables 47 from trigger circuit 48. Trigger circuit 48 is depicted as located within power supply 15. Trigger circuit 48 is also connected to the gate electrodes of silicon controlled rectifiers 34, 35, and 36 for providing trigger signals to the silicon controlled rectifiers. Trigger circuit 48 will be described in more detail with relation to the block diagram of FIG. 5.

The operation of the circuit depicted in FIG. 2 is as follows: upon closing of switch 21, high voltage in the secondary of transformer 22 is rectified by rectifier 27 to provide high voltage charging current to capacitors 24, 25, and 26. The first flash sequence is then provided by trigger circuit 48 triggering silicon controlled rectifier 34 "on." During the "on" trigger of rectifier 34, trigger circuit 48 provides an ionizing trigger pulse to flashlamp 38 through pulse transformer 44. This causes capacitor 24 to discharge through flashlamp 38. After a time interval that is dependent upon the size and shape of the flash discharge pulse, but which will commonly be at least one half millisecond, trigger circuit 48 triggers second silicon controlled rectifier 35. This silicon controlled rectifier must be fired sufficiently long after the firing of first flashlamp 38 to permit flashlamp 38 to deionize to the point where the charge from capacitor 25 will not now discharge through lamp 38. During the trigger pulse to the gate of silicon controlled rectifier 35, a trigger pulse is supplied to pulse transformer 45 for ionizing the second flashlamp 39. With similar time spacing, silicon controlled rectifier 36 is in turn triggered and pulse transformer 46 is supplied with a trigger pulse for flashing flashlamp 40.

By timing the sequence of flashing of the group of flashlamps 12 so that there is at least a half millisecond between the firing of each flashlamp and no more than 20 milliseconds, the flashlamps will have the appearance, to the human eye, of firing simultaneously while sufficient separation can be maintained so that the discharges through the respective flashlamps operate in separate time instances whereby current through cables 37 and 42 never significantly exceeds the maximum current provided for one flashlamp.

The repitition rate of group flashing in a system such as described is normally one per second or slower. Resistors 28, 29, and 30 have a resistance small enough to permit complete recharging of the respective capacitors 24, 25, and 26 during the cycle period but large enough to prevent current from transformer 22 maintaining ionization of a flashlamp beyond the desired flash interval.

FIG. 3 depicts an alternative embodiment to FIG. 2 in which trigger circuit 50 triggers only the respective flashlamps 38, 39, and 40. In this embodiment, discharge capacitors 24, 25, and 26 are connected to a charging source 51 through resistors 28, 29, and 30 respectively. Capacitors 24, 25, and 26 are directly connected across flashlamps 38, 39, and 40 respectively by means of a common cable 42 going to the cathodes of flashlamps 38, 39, and 40 and separate cables 54, 55, and 56 connected to the anodes of flashlamps 38, 39, and 40 respectively. Pulse transformers 57 (shown in block form) may be the same as pulse transformers 44, 45, and 46 depicted in FIG. 2. The same numbers are used in FIG. 3 as in FIG. 2 to designate corresponding circuit components.

The circuit of FIG. 3 requires an additional power discharge cable for each additional flashlamp but does not require the silicon controlled rectifiers of FIG. 2 or the trigger circuitry for operating the silicon controlled rectifiers. Again, as in FIG. 2, all capacitors 24, 25, and 26 are charged through the respective resistors 28, 29, and 30, and then trigger circuit 50 sequentially triggers flashlamps 38, 39, and 40 in such rapid succession as to appear to the human eye as a single flash but with sufficient separation so that common cable 42 does not see a peak current significantly greater than the peak discharge current through one flashlamp. The sequence speed for each group flashing is again the same as in FIG. 2.

Figure 4:
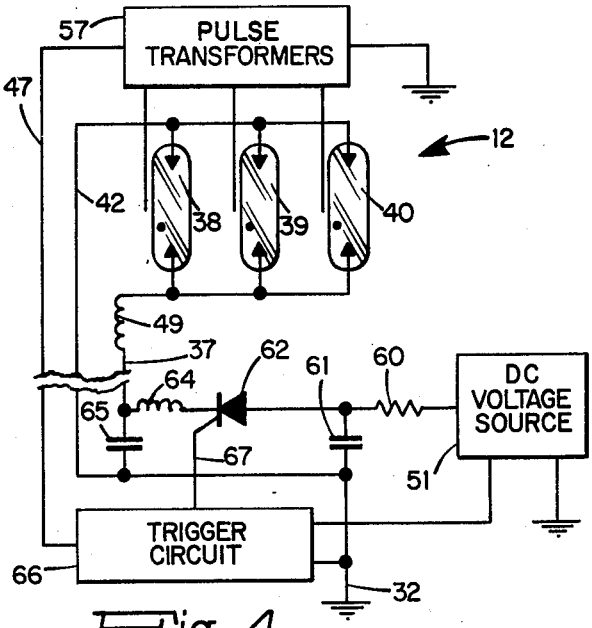
FIG. 4 is a simplified schematic diagram of a flash beacon system according to a third embodiment of the invention; and, FIG. 5 is a block diagram of a sequential trigger circuit according to the invention.

FIG. 4 uses still a further arrangement reducing the number of silicon controlled rectifiers as compared to FIG. 2 and needing only two common cables 37 and 42. In FIG. 4 a single charging resistor 60 is connected between DC voltage source 51 and capacitor 61. Capacitor 61 should have a size approximately equivalent to the total size of capacitors 24, 25, and 26 combined so as to have enough capacity to discharge all flashlamps 38, 39, and 40 simultaneously.

The common connection of capacitor 61 and resistor 60 is also connected to the anode of silicon controlled rectifier 62. Current limiting inductor 64 connects the cathode of silicon controlled rectifier 62 to capacitor 65. Capacitor 65 has the capacity to provide discharge current for a single flash of one of the flashlamps 38, 39, and 40. The reference sides of capacitors 61 and 65 are connected to reference 32 as is cable 42 going to beacon lamps 12 and connecting to the cathode electrodes of flashlamps 38, 39, and 40. The common connection of inductor 64 and capacitor 65 is connected by cable 37 to the anodes of flashlamps 38, 39, and 40. The gate electrode of silicon controlled rectifier 62 is connected to trigger circuit 66 by lead 67. Trigger circuit 66 is also connected to pulse transformers 57 by cable 47 for providing trigger to lamps 12.

The circuit of FIG. 4 operates by the charging of capacitor 61 from source 51 through current limiting resistor 60. Then upon time for a group flash, trigger circuit 66 triggers silicon controlled rectifier 62 to charge capacitor 65 to substantially twice the voltage of capacitor 61. Silicon controlled rectifier 62 can turn off as soon as the current flow stops. Then trigger circuit 66 provides a trigger pulse through the first of pulse tranformers 57 to flashlamp 38 discharging capacitor 65 through flashlamp 38. Trigger circuit 66 then again triggers silicon controlled rectifier 62 to transfer another charge from capacitor 61 to capacitor 65, whereupon trigger circuit 66 triggers the second flashlamp 39 to discharge the same capacitor 65 through flashlamp 39. The same timing intervals would be used as in the circuits of FIGS. 2 and 3. That is, in a group of flashing sequence, the intervals between triggering would be in the range of ½ millisecond to 20 milliseconds apart and the cycle period between group flashes would commonly be in the vicinity of one second or more.

The circuit parameters in all of these embodiments of the invention involve the resistance of flashlamps, the amount of energy in joules expected to be provided in each flash, the resistance in the rest of the circuit, the inductance in the circuit, the size of the storage capacitors, and the voltage to be applied. These can be readily varied in accordance with known formulae to attain the timing sequences and cycle periods utilized in beacon lamps.

Figure 5:
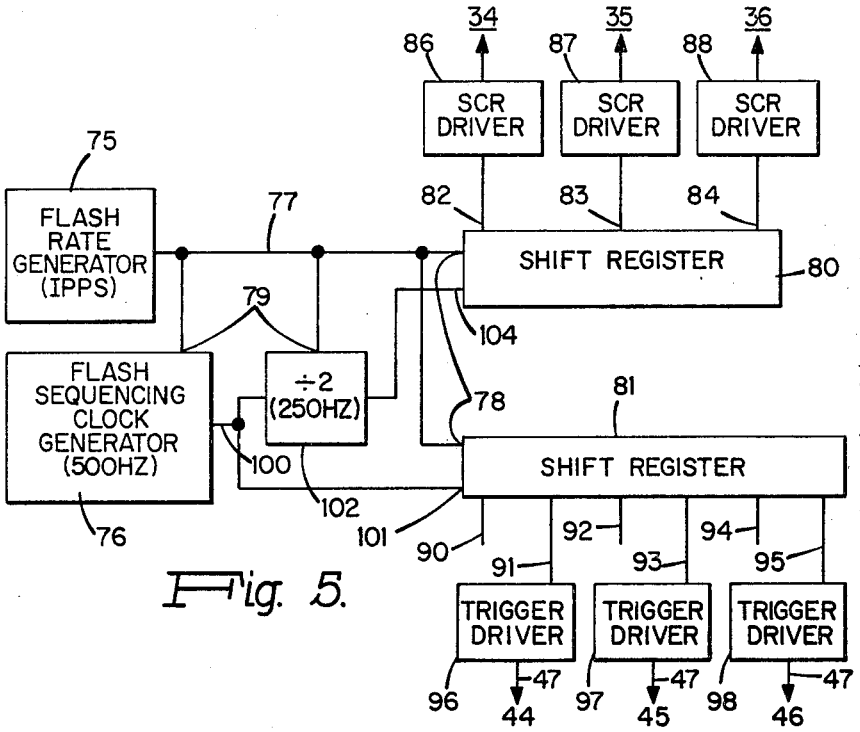
Figure 6:
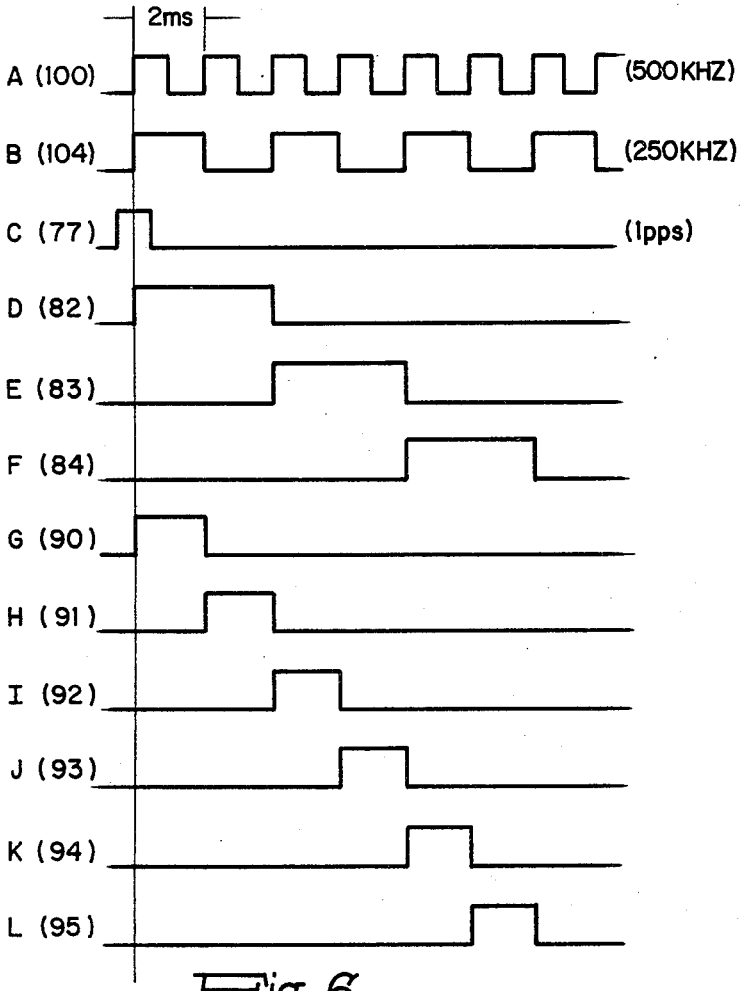
FIG. 6 is a timing diagram for the trigger circuit of FIG. 5.

FIG. 5 is a block diagram of trigger circuit 48 of FIG. 2 and FIG. 6 is a timing diagram depicting typical timing for trigger circuit 48. Since trigger circuits and their variations have become so generally well known in the art today, only trigger circuit 48 is described in greater detail. Trigger circuits 50 and 66 are obvious variations readily designed within the skill of the art and further description of them is felt unnecessary.

Trigger circuit 48 uses two pulse generators. Flash rate generator 75 provides reset pulses at the overall cycle rate of the system. Clock generator 76 provides the much higher frequency flash sequencing pulses. Generators 75 and 76 are suitably free-running oscillators but may be synchronized by the AC power line or other standard for synchronous operation with other nearby systems.

Output 77 of generator 75 is connected to two reset inputs 78 of shift registers 80 and 81. Register 80 has at least three shift outputs 82, 83, and 84 connected to actuate SCR drivers 86, 87 and 88. Driver 86 is connected to the gate of SCR 34 and drivers 87 and 88 are connected to the gates of SCRs 35 and 36 respectively. Register 81 has at least six shift outputs 90 through 95 with outputs 91, 93, and 95 connected to actuate trigger drivers 96, 97 and 98 respectively. Trigger drivers 96, 97 and 98 are connected by lines 47 to pulse transformers 44, 45, and 46 respectively. (See FIG. 2)

Output 77 of generator 75 is also connected to two reset inputs 79 of generator 76 and scaler 102. Clock generator 76 has its output 100 connected to shift input 101 of register 81. Output 100 is also connected to divide by two scaler 102 which in turn is connected to shift input 104 of register 80.

Trigger circuit 48 and its operation will be understood much better by reference to the timing diagram in FIG. 6. Top waveform A is a typical output of clock generator 76 appearing at output 100. Waveform B is scaled input 104 from scaler 102 at half the frequency of waveform A. Waveform C is the output of generator 75 on line 77. Waveforms A and B are shown as 500 Khz and 250 Khz square waves with 2 and 4 milliseconds periods respectively. Waveform C is a 1 Hz waveform in which the output is depicted as a short positive pulse of about 1 millisecond in length. The nature of this pulse is only critical in that it should be such as to reset shift registers 80 and 81 only once in each period. Waveforms D, E and F represent outputs 82, 83 and 84 of register 80 as the register is shifted and waveforms G through L represent outputs 90 through 95 of register 81 as it is shifted.

The leading edge of the positive pulse in waveform C resets generator 76, scaler 102 and registers 80 and 81. Immediately following reset, generator 76 provides a positive going pulse on waveform A shifting register 81 to output 90 which is unconnected. Scaler 102 is connected to provide an output to register 80 on the first and every other input pulse. Thus a positive going pulse on waveform B shifts register 80 to output 82 enabling SCR 34 at the same time register 81 shifts to output 90. The next positive going pulse in waveform A shifts register 81 to output 91 providing a trigger to pulse transformer 44 to fire lamp 38 during the on time of SCR 34. This sequence is repeated during the firing of all lamps 38, 39 and 40 at which point the shift registers 80 and 81 have either reached their terminal condition or continue to their terminal conditions by activating unconnected outputs and thereupon stop until reset. The sequence then keeps repeating at the period of waveform C.

While the invention has been described with respect to specific embodiments, many variations are possible within the contemplated inventive concept. For example, instead of using pulse transformers, so called injection triggering can be used on the flashlamps. Also, any number of flashlamps can be used and a sequential firing of a group of lamps for a substantially instantaneous flash can include firing two or more lamps exactly simultaneously and then two or more further lamps ½ millisecond or more later and so forth in a sequence for a group of a large number of lamps. Accordingly, it is intended to cover the invention within the full scope of the appended claims.

I claim:

1. Flashlamp apparatus for flashing a plurality of flashlamps substantially simultaneously at a location remote from a capacitive discharge power source comprising:

a. a plurality of flashlamps;

b. a capacitive discharge power supply having capacitive storage sufficient to flash said plurality of flashlamps;

c. cables connecting said power supply to said plurality of flashlamps for carrying capacitive discharge current to flash said flashlamps and at least one of said cables connected to provide discharge current in common to said plurality of flashlamps; and, d. a trigger circuit connected to trigger each of said plurality of flashlamps in rapid sequence such that the current through said at least one of said cables does not significantly exceed the maximum instantaneous current for flashing one flashlamp while said plurality of flashlamps have the appearance of flashing simultaneously.

2. Flashlamp apparatus according to claim 1 wherein said trigger circuit comprises means to provide triggers in rapid sequence groups, the triggers within each group being spaced in the range of one half to twenty milliseconds apart.

3. Flashlamp apparatus according to claim 1 wherein a separate capacitor is provided for each flashlamp, a first cable connects one side of each said capacitor in common to a first electrode of each of said flashlamps in common and a second cable is connected exclusively from each said capacitor to a second electrode of each of said flashlamps.

4. Flashlamp apparatus according to claim 1 wherein said power supply additionally comprises a single capacitor with capacity to provide a single flash discharge for one of said lamps, said single capacitor being connected for charging from capacitive storage by operation of an electronic switch connected to said trigger circuit for triggering prior to each flash in a rapid sequence so as to charge said single capacitor.

5. Flashlamp apparatus according to claim 1 wherein said capacitive storage includes a separate capacitor for flashing each flashlamp and an electronic switch connected between each separate capacitor and its respective flashlamp, and said trigger circuit being connected to each electronic switch for triggering each electronic switch in rapid sequence and flashing said flashlamps.

6. Flashlamp apparatus according to claim 5 wherein said trigger circuit is additionally connected to a plurality of pulse transformers associated with respective ones of said flashlamps and includes means to synchronize pulses to said pulse transformers with triggers to each respective electronic switch, said pulse transformers connected to ionizing electrodes for ionizing each flashlamp in sequence while the respective electronic switch is closed.

7. A method of flashing a plurality of flash beacon units substantially simultaneously at a remote location from a capacitive discharge power supply to which said beacon units are connected by current discharge cables at least one of which is connected to said plurality of beacon units in common comprising:

a. charging the energy storage capacitors of said capacitive discharge power supply with sufficient electrical energy to flash all of said plurality of flash beacon units;

b. triggering individual discharges through each of said plurality of flash beacon units from said capacitive discharge power supply in time sequence in which the interval between flashing of each unit in said plurality of flash beacon units is in the range of one half millisecond to 20 milliseconds; and, c. repeating the preceding steps at cyclical intervals, all whereby current for flashing each unit in said plurality of flash beacon units passes through said at least one current discharge cable without the instantaneous peak current in said cable significantly exceeding the maximum instantaneous discharge current for a single one of said units.

* * * * *